US005133347A

United States Patent [19]

Huennebeck

[11] Patent Number: 5,133,347

[45] Date of Patent: Jul. 28, 1992

[54] MOUTHPIECE VALVE FOR BREATHING EQUIPMENT

[75] Inventor: Volker Huennebeck, Berlin, Fed. Rep. of Germany

[73] Assignee: Auergesellschaft GmbH, Fed. Rep. of Germany

[21] Appl. No.: 442,942

[22] Filed: Nov. 28, 1989

[30] Foreign Application Priority Data

Dec. 15, 1988 [DE] Fed. Rep. of Germany ..... 3842222

[51] Int. Cl.[5] ..... A62B 9/02

[52] U.S. Cl. ..... 128/205.24; 128/201.18; 128/201.28; 128/207.14

[58] Field of Search ..... 128/201.28, 205.24, 128/201.18, 201.26, 201.27, 204.26, 200.29, 201.11, 207.16, 207.17, 207.14

[56] References Cited

U.S. PATENT DOCUMENTS 2,839,053 6/1958 Lorenz ..... 128/205.24

4,090,511 5/1978 Gray ..... 128/207.14

*Primary Examiner*—Edgar S. Burr

*Assistant Examiner*—Stephen R. Funk

*Attorney, Agent, or Firm*—Reed Smith Shaw & McClay

[57] ABSTRACT

A mouthpiece valve for breathing equipment which utilizes a spring-loaded axially movable valve disc to close the connection to the breathing equipment when the valve is in an inoperative position. To lock the valve in the closed position, it is provided with two tapered pins which are externally inserted into the cover of the valve casing and which abut a curved member which is in operative connection with the valve disc via a valve stem. The two tapered pins are secured by a safety bridge placed on the cover which locks the curved member to the valve stem and the valve disc and maintains the valve in a closed position. To open the closed valve, the safety bridge is removed in a single motion, preferably by means of a cord disposed on a nose clip when the nose clip is put on for use of the breathing equipment.

10 Claims, 2 Drawing Sheets

MOUTHPIECE VALVE FOR BREATHING EQUIPMENT

FIELD OF THE INVENTION

The present invention relates to a mouthpiece valve for breathing equipment and more particularly to a mouthpiece valve which can be locked in a closed position prior to use and subsequently unlocked by a single motion of the user when the breathing equipment is to be used.

BACKGROUND OF THE INVENTION

Mouthpiece valves for breathing equipment typically employ two pins directly connected to the valve disc. The valve disc is moved along the axis of the valve stem by the user's lips in order to open the valve. The two pins are in turn displaced by the movement of the valve disc. Such a mouthpiece valve is shown in U.S. Pat. No. 4,090,511. The disadvantage with this device is that there is no means of preventing premature movement of the pins and disc and thus the opening of the valve since the pins can be axially displaced at any time prior to the intended opening of the valve. The resultant unintended opening of the valve is particularly undesirable for two reasons. First, it is possible to expend an indeterminate portion of the air stored in the breathing equipment. Also, the user may be unaware of this escape because the valve disc may subsequently be returned to the closed position, thereby concealing the escape. The user would then have only a fraction of the anticipated capacity of the breathing equipment available for use. Secondly, if the mouthpiece valve is used in breathing equipment which is deployed underwater, when the valve disc moves water can flow through the valve into the breathing equipment. If the breathing equipment uses a chemical canister, this could render it unusable.

It would be desirable therefore to provide a mechanism for reliably locking the mouthpiece valve in the closed position during storage and transport so that the user can be assured that the first time valve is opened is when the user intentionally opens it during use. Furthermore, the locking means should be able to be quickly and easily unlocked, preferably in a single motion by the user, at the desired time when the breathing equipment is to be used.

SUMMARY OF THE INVENTION

Generally the present invention relates to a mouthpiece valve for breathing equipment which is opened by a user with his lips by moving a flange member mounted on the mouthpiece. The flange member is connected to a valve stem which is in turn connected to a valve disc so that when the flange member is moved, the valve stem and valve disc move axially thereby opening the passageway to the breathing equipment. To prevent premature opening of the valve, movement of the valve stem is initially prevented by the placement of two tapered pins in a cover of the valve casing with their narrow ends abutting a connecting member connected to the valve stem. The pins are in turn secured by a safety bridge placed in contact with the wide end of the tapered pins. The safety bridge straddles a short length of cord by which cord a nose clip is connected to the cover of the mouthpiece valve, so that when the nose clip is put on by the user, the safety bridge is displaced by the cord, thereby allowing the tapered pins to fall free and enabling the valve stem and valve disc to move axially.

Other details, objects and advantages of the present invention will become readily apparent from the following description of a presently preferred embodiment thereof.

BRIEF DESCRIPTION OF THE DRAWINGS

In the accompanying drawings, a preferred embodiment of the present invention is illustrated by way of example only, wherein.

DESCRIPTION OF THE PREFERRED EMBODIMENT

Figure 1:
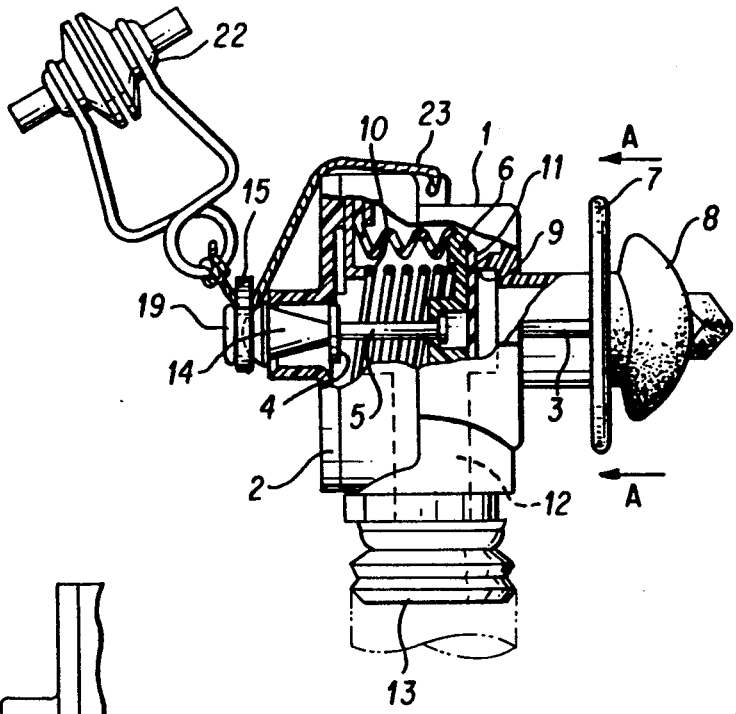
FIG. 1 is a side view of the present invention, in elevation and with a portion of the valve casing cut away, and with the valve locked in the closed position.
Figure 1A:
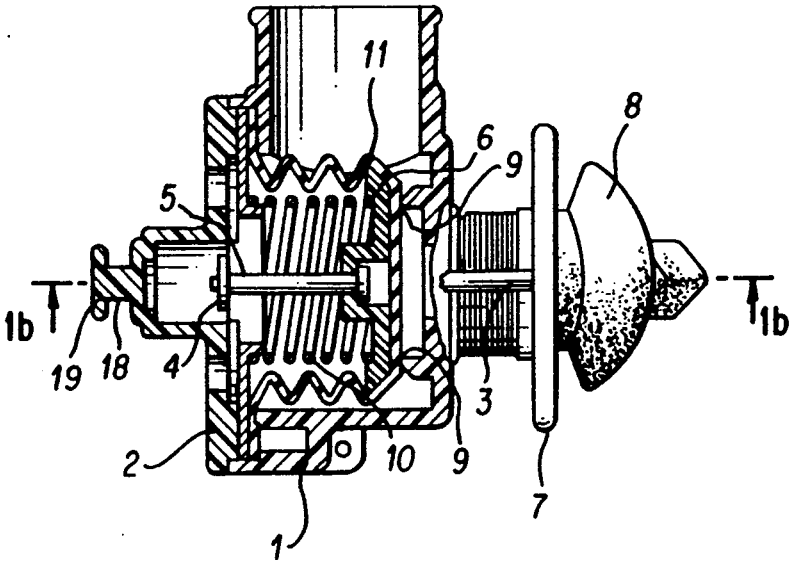
FIG. 1*a* is a section taken parallel to the elevation of FIG. 1, and at the centerline of the present invention, with the valve locked in the closed position.
Figure 2A:
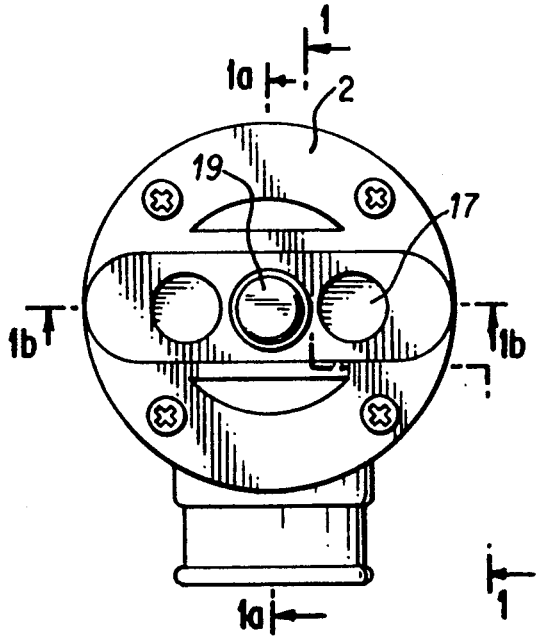
FIG. 2*a* is a front view of the present invention with the safety bridge, tapered pins, safety strip, nose clip and cord all removed.
Figure 1B:
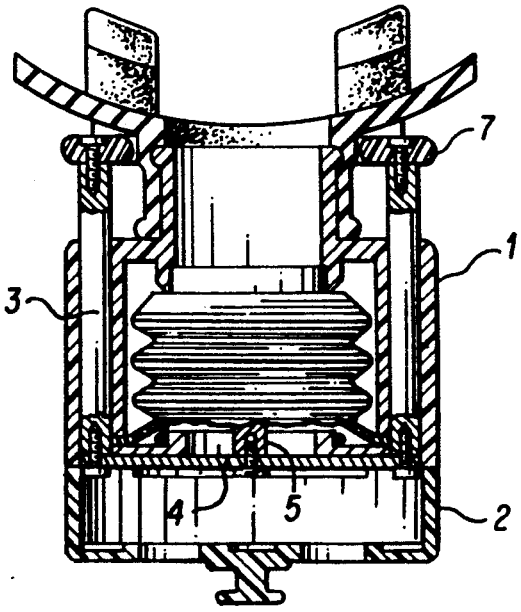
FIG. 1*b* is a section of the present invention taken perpendicular to those of FIGS. 1 and 1*a*, at the centerline of the invention.

As shown in FIGS. 1, 1*a* and 1*b*, the mouthpiece valve comprises a valve casing 1, a cover 2 which closes the casing 1, two movable pins 3 extending outwardly from the casing 1 and mounted in the cover 2 for axial movement therein, and a connecting member 4 disposed within the cover 2 and at the end of the pins 3 and which is substantially perpendicular to and connects the two pins 3. The pins 3 each project into the interior of the valve casing 1. The mouthpiece valve further comprises a valve stem 5 disposed perpendicular to and concentrically with a valve disc 6 and parallel to and between the two moveable pins 3, with one end abutting the connecting member 4 and the other end abutting the valve disc 6, which valve disc 6 is loaded by a spring 10 and to which a resilient plate 11 is permanently attached. The resilient plate 11 is in contact with a valve seat 9 when the mouthpiece valve is in the closed position. A flange member 7 is permanently disposed on the ends of the moveable pins 3 which project from the valve casing 1 and travel axially (direction "A" in FIG. 1) along a cylindrical portion of the casing 1 which terminates in a mouthpiece 8.

When the mouthpiece valve is in the closed position, the valve seat 9 in the valve casing 1 is closed so that no air can pass from the breathing equipment (not shown) through tube 13 and access opening 12 and through the breathing valve, thereby preserving the supply of breathing air in the breathing equipment.

Figure 3:
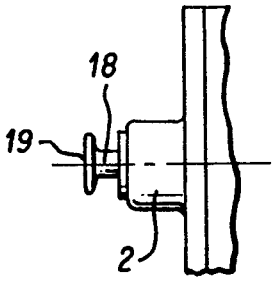
FIG. 3 shows the knob portion of the mouthpiece valve on which the slotted safety bridge is placed.
Figure 4:
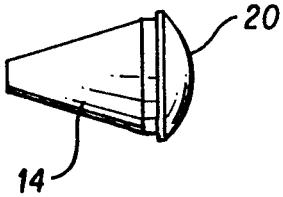
FIG. 4 shows one of the tapered pins.
Figure 2:
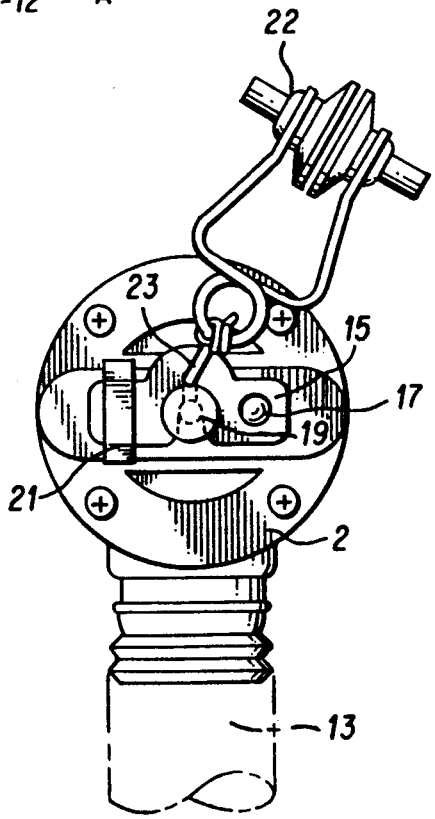
FIG. 2 is a front view of the present invention shown in FIG. 1 showing the safety bridge positioned on the knob, the safety strip over the cap of one of the tapered pins and the nose clip disposed on a cord, which cord is inserted in a slot in the safety bridge.
Figure 5:
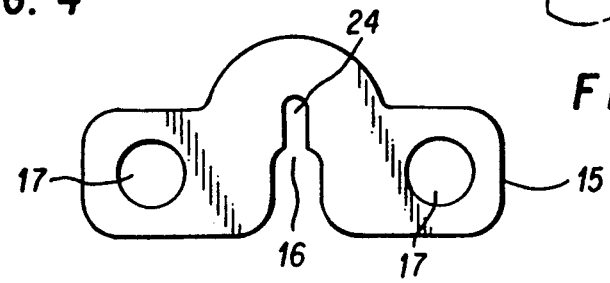
FIG. 5 shows the slotted safety bridge.

To keep the mouthpiece valve in the closed position until the user intends to open it, the valve disc 6 and resilient plate 11 must be locked to the valve seat 9 and the connecting member 4 must be locked to the pins 3 and flange member 7 in such a way that these components are prevented from moving axially (direction A in FIG. 1). To achieve this, two tapered pins 14 (see FIG. 4) are loosely inserted into cover 2 so as to abut connecting member 4 (see FIG. 1) and are secured by safety bridge 15 (see FIG. 5) whose central slotted recess 16 is placed on pin 18 of knob 19 (see FIG. 3) of cover 2 in such a way that the convex caps 20 formed on the wide end of tapered pins 14 are resiliently engaged by circular holes 17 of the safety bridge 15. To ensure that the mouthpiece valve has not been opened and the contents of the breathing equipment depleted, a seal in the form of a safety strip 21 (see FIG. 2) is stuck over one of the circular holes 17 of the safety bridge 15.

When the breathing equipment is put into operation it is necessary, preferably in one motion, to unlock the flange member 7 so that the valve disc 6 and resilient plate 11 can immediately be moved to the open position. To do this, the user puts on a nose clip 22, which is securely connected to the safety bridge 15 with a cord 23 disposed on the casing 1 and inserted into a slot 24 in the safety bridge 15 before the safety bridge is placed on the pin 18 of knob 19. In the process of putting on the nose clip, the safety bridge 15 is removed and the two tapered pins 14 are moved out of the locked position, breaking the safety strip 21. The tapered pins 14 fall out of the cover 2 and the flange member 7 can now freely be moved axially (in direction "A") by the user's lips, thereby opening the mouthpiece valve.

The advantage of this arrangement is that the mouthpiece valve reliably remains in a closed position while packed and not in use. Until the breathing equipment is put on, it cannot be unlocked and opened without the additional operation of putting on the nose clip 22. Advantageously, to ensure that the mouthpiece valve is automatically unlocked and put in the operating position when the nose clip 22 is put on, the length of the cord 23 securing the nose clip is such that the nose clip 22, hanging down from the back of the valve, is disposed in the angle of view of the wearer and below the safety bridge 15.

While a presently preferred embodiment of practicing the invention has been shown and described with particularity in connection with the accompanying drawings, the invention may otherwise be embodied within the scope of the following claims.

What is claimed is:

1. A mouthpiece valve for breathing equipment comprising: a valve casing; a valve seat, the valve seat being inside the valve casing; an axially movable valve disc, the valve disc being contained within the valve casing and being in operative connection with the valve seat; a valve stem having a first end connected to the valve disc; two movable pins, the movable pins being disposed substantially parallel to and on either side of the valve stem, the moveable pins having a first end outside the valve casing and a second end inside the valve casing; a connecting member, the connecting member being disposed inside the valve casing and substantially perpendicular to the two movable pins and connected between a second end of the valve stem and the second end of each movable pin; a flange member, the flange member being disposed outside the valve casing and substantially perpendicular to the two movable pins at the first ends thereof, the flange member capable of being moved in conjunction with the movable pins and the valve disc between a first position in which the valve disc is not in contact with the valve seat such that air can pass through the valve seat, and a second position in which the valve disc is in operative contact with the valve seat such that air cannot pass therethrough; a biasing means to bias the valve disc into the second position; a front cover for the valve casing containing at least one circular hole; at least one removable pin, the removable pin being partially insertable into the hole in the cover such that a first end of the removable pin abuts the connecting member when the valve disc is in the second position; and a locking mechanism for securing the removable pin in the hole in the cover.

2. A mouthpiece valve as described in claim 1 wherein two removable pins are used and there are two holes in the cover.

3. A mouthpiece valve as described in claim 2 wherein the locking mechanism comprises an attachable safety bridge, the safety bridge having a slotted recess and engaging a second end of each removable pin; and wherein a knob is formed on the cover such that the safety bridge is placeable on the knob by sliding the slotted recess in the safety bridge over the knob.

4. A mouthpiece valve as described in claim 3 further comprising a cord having one end disposed on the valve casing and capable of being received in the slotted recess of the safety bridge.

5. A mouthpiece valve as described in claim 4 wherein a nose clip is disposed on the other end of the cord from the valve casing.

6. A mouthpiece valve as described in claim 5 wherein a safety strip is firmly attached to the cover and disposed over safety bridge.

7. A mouthpiece valve as described in claim 6 wherein to enable the valve disc to be moved from the second position to the first position, the safety bridge is removed from the knob by the cord inserted into the slotted recess when the nose clip is utilized such that the removable pins which are inserted in the holes in the cover, fall out when they are no longer engaged and restrained by the safety bridge.

8. A mouthpiece valve as described in claim 7 wherein the length of the cord is such that the nose clip hanging down from the mouthpiece valve is below the safety bridge and in an angle of view of a user.

9. A mouthpiece valve as described in claim 2 wherein the removable pins are tapered and have convex caps at their wide end.

10. A mouthpiece valve as described in claim 9 wherein the safety bridge has two holes in it which engage the convex caps of the tapered pins when the safety bridge is placed over the knob.

* * * * *